US005457941A

United States Patent [19]

Long et al.

[11] Patent Number: 5,457,941

[45] Date of Patent: Oct. 17, 1995

[54] ENVELOPE STUFFING MACHINE

[75] Inventors: John D. Long; John A. Long, both of Scarborough, Canada

[73] Assignee: Longford Equipment International Limited, Ontario, Canada

[21] Appl. No.: 310,365

[22] Filed: Sep. 22, 1994

Related U.S. Application Data

[63] Continuation of Ser. No. 64,553, May 21, 1993, abandoned, which is a continuation-in-part of Ser. No. 946,903, Sep. 18, 1992, abandoned.

[51] Int. Cl.[6] ..... B65B 5/06; B65B 43/32; B65B 43/36

[52] U.S. Cl. ..... 53/460; 53/252; 53/258; 53/284.3; 53/381.6; 53/569

[58] Field of Search ..... 53/570, 284.3, 53/381.5, 381.6, 381.7, 385.1, 386.1, 252, 258, 460, 473, 469, 569

[56] References Cited

U.S. PATENT DOCUMENTS

| | | | |
|---|---|---|---|
| 2,736,999 | 3/1956 | Rouan et al. | 53/284.3 X |
| 2,746,221 | 5/1956 | Rouan et al. | 53/284.3 X |
| 3,858,381 | 1/1975 | Huber et al. | 53/284.3 X |
| 3,881,299 | 5/1975 | Bate | 53/252 X |
| 3,935,800 | 2/1976 | Sette et al. . | |
| 3,974,623 | 8/1976 | Bate | 53/252 X |
| 4,020,615 | 5/1977 | Irvine et al. . | |
| 4,055,932 | 11/1977 | Wanner . | |
| 4,205,506 | 6/1980 | Moens et al. . | |
| 4,319,444 | 3/1982 | Russell | 53/284.3 X |
| 4,525,986 | 7/1985 | Noll | 53/252 X |
| 4,712,359 | 12/1987 | DePasquale et al. | 53/252 X |
| 4,781,013 | 11/1988 | DePasquale et al. | 53/284.3 |
| 4,798,040 | 1/1989 | Haas et al. . | |
| 5,024,042 | 6/1991 | Meyer | 53/252 X |
| 5,058,364 | 10/1991 | Seiden et al. | 53/570 X |
| 5,125,214 | 6/1992 | Orsinger et al. | 53/284.3 X |
| 5,182,898 | 2/1993 | Tung et al. | 53/570 |

FOREIGN PATENT DOCUMENTS

| | | |
|---|---|---|
| 0392867 | 10/1990 | European Pat. Off. . |
| 0485932 | 5/1992 | European Pat. Off. . |

*Primary Examiner*—Horace M. Culver

[57] ABSTRACT

An on-the-fly envelope stuffing apparatus has an envelope feeder comprising a pair of parallel feed belts for underlying the back panel of the envelope and a laterally aligned medial feed belt for overlying the front panel of the envelope. The medial feed belt descends below the level of the parallel feed belts in the downstream direction. An envelope fed lengthwise through the belts is bent so that the envelope flap is partially opened. This allows interposition of a flap guide to fully open the envelope. The envelope feeder dispenses the envelopes serially to an envelope conveyor. An endless tray conveyor parallels the envelope conveyor. Each tray supports an insert stack against which arms on the tray rest. As the trays move downstream in synchronism with envelopes on the envelope conveyor, each tray is cammed toward an envelope so that the arms enter the opening of the envelope. A pusher on the tray then pushes the inserts toward the envelope which also cams the arms so that they move toward the side edges of the envelope and are raised to open the envelope to facilitate insertion of the inserts.

17 Claims, 6 Drawing Sheets

ENVELOPE STUFFING MACHINE

CROSS-REFERENCE TO RELATED APPLICATIONS

This application is a continuation of U.S. application Ser. No. 08/064,553, filed May, 21, 1993, now abandoned, which in turn is a continuation-in-part of U.S. application Ser. No. 07/946,903, filed on Sep. 18, 1992, now abandoned.

BACKGROUND OF THE INVENTION

1. Field of the Invention

This invention relates to an on-the-fly envelope stuffing apparatus and to a method for on-the-fly envelope stuffing.

2. Description of the Related Art

U.S. Pat. No. 4,525,986 to Noll relates to an on-the-fly envelope stuffing apparatus. The envelopes are conveyed along a path and a series of insert supporting trays are conveyed along a parallel path. At an inserting station, spring fingers of an overlying conveyor hold the envelope in an open position while fingers associated with the trays push the inserts into envelopes.

SUMMARY OF THE INVENTION

According to the present invention, there is provided an on-the-fly envelope stuffing apparatus for an envelope of the type having a back panel with a flap, a front panel meeting said back panel at side and bottom edges and an opening at the base of said flap, comprising the following: means to convey an envelope downstream continuously along a first path; means to support the back panel of the envelope while leaving the front panel proximate the flap free to move away from the back panel; means to continuously convey a stack of inserts downstream along a second path merging with said first path at an inserting station, said insert conveying means comprising a tray for supporting a stack of inserts, said tray for merging toward said first path, and a pusher for pushing said stack of inserts from said tray at said inserting station; means to form a feed path for said stack of inserts from said tray to an envelope at said inserting station comprising a pair of arms mounted to said tray, each arm of said pair of arms having a free end, said pair of arms moveable to a guiding position whereat each free end abuts the top of a stack of inserts on said tray and whereat said pair of arms project toward said first path sufficiently that each said free end merges into said opening of said envelope at said inserting station, said pair of arms moveable while in said guiding position such that the free ends of said arms move away from each other, and means to move said pair of arms when in said guiding position at said inserting station such that the free ends of said pair of arms move away from each other to adjacent the side edges of the envelope.

In another aspect, there is provided an on-the-fly envelope stuffing apparatus for an envelope of the type having a back panel with a flap, a front panel meeting said back panel at side and bottom edges and an opening at the base of said flap, comprising the following: means for opening the flap of an envelope comprising a pair of parallel feed belts for supporting the back panel of said envelope and a medial feed belt laterally aligned with said pair of parallel feed belts and which is below the level of said pair of feed belts at least at a downstream end of said feed belts, said feed belts for feeding an envelope in said downstream direction while said medial feed belt acts against the front panel of said envelope to progressively bend said envelope in order to partially open said flap; means to convey said envelope continuously downstream from said envelope opening means along a first path; means to continuously convey a stack of inserts downstream along a second path merging with said first path at an inserting station; and means to form a feed path for said stack of inserts from said tray to an envelope at said inserting station.

The present invention also comprises a method for on-the-fly envelope stuffing comprising the following steps: bending an envelope moving downstream along its length in order to partially open the envelope flap; fully opening the envelope flap; conveying said envelope downstream from said envelope opening means along a first path; conveying a stack of inserts downstream along a second path merging with said first path at an inserting station; and forming a feed path for said stack of inserts from said tray to an envelope at said inserting station whereby inserts are fed in said envelope.

In a further aspect, the present invention comprises a method for on-the-fly envelope stuffing comprising the following steps: conveying said envelope downstream from an envelope opening means along a first path; supporting the back panel of the envelope proximate the side edges of the envelope while leaving the front panel of the envelope proximate the flap free to move away from the back panel; conveying a stack of inserts downstream along a second path merging with said first path at an inserting station and including pushing said stack of inserts from a tray supporting said stack at an inserting station; forming a feed path for said stack of inserts from said tray to an envelope at said inserting station comprising positioning the free ends of a pair of arms to rest against the top of said stack of inserts, moving the arms into the opening of an envelope, and separating the free ends of the arms so that each free end is positioned adjacent one of said side edges of said envelope whereby inserts are fed into said envelope.

BRIEF DESCRIPTION OF THE DRAWINGS

In the figures which disclose example embodiments of the invention.

DESCRIPTION OF THE PREFERRED EMBODIMENTS

Figure 1:
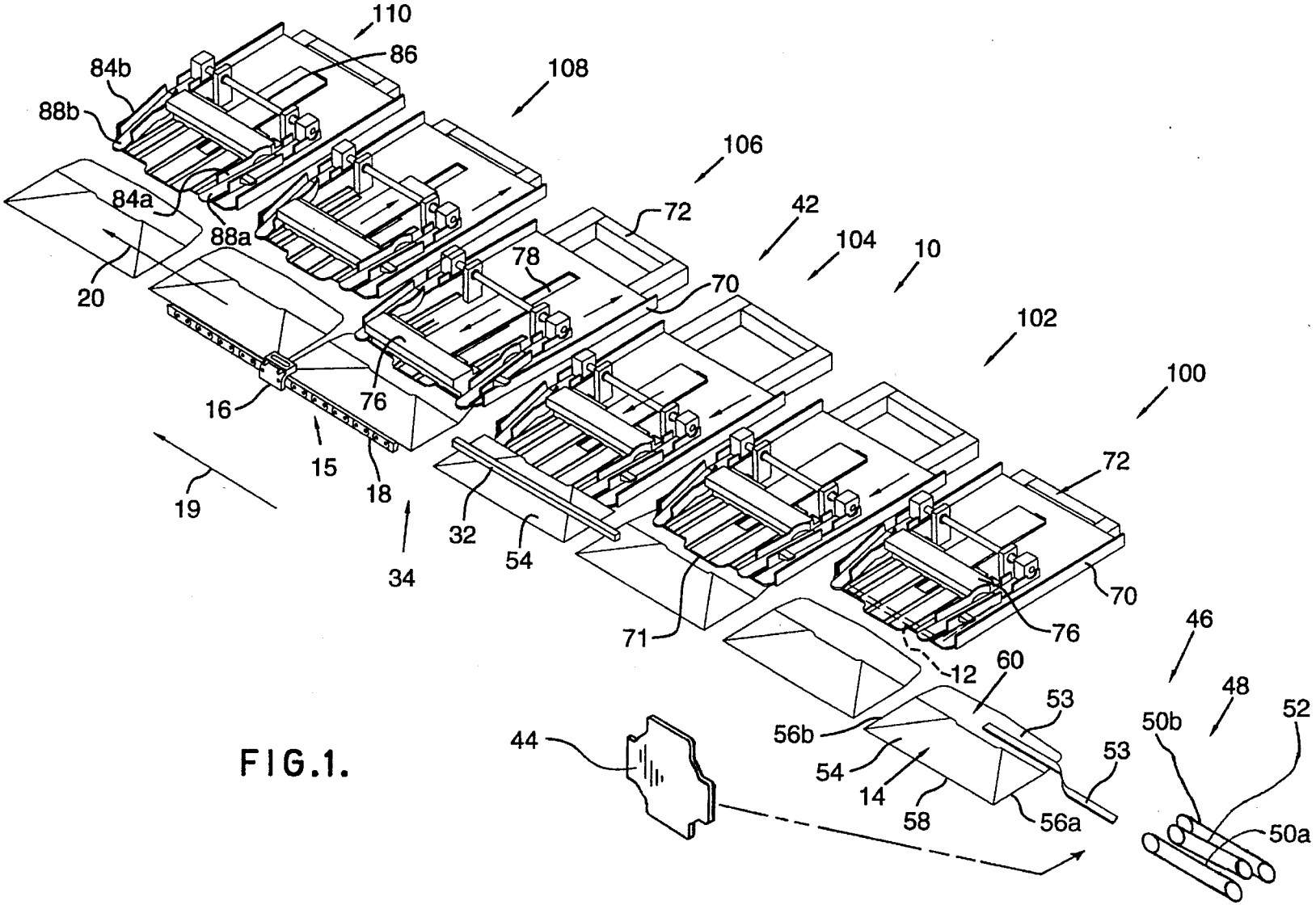
FIG. 1 is a schematic perspective view of an on-the-fly envelope stuffing apparatus made in accordance with this invention.
Figure 2:
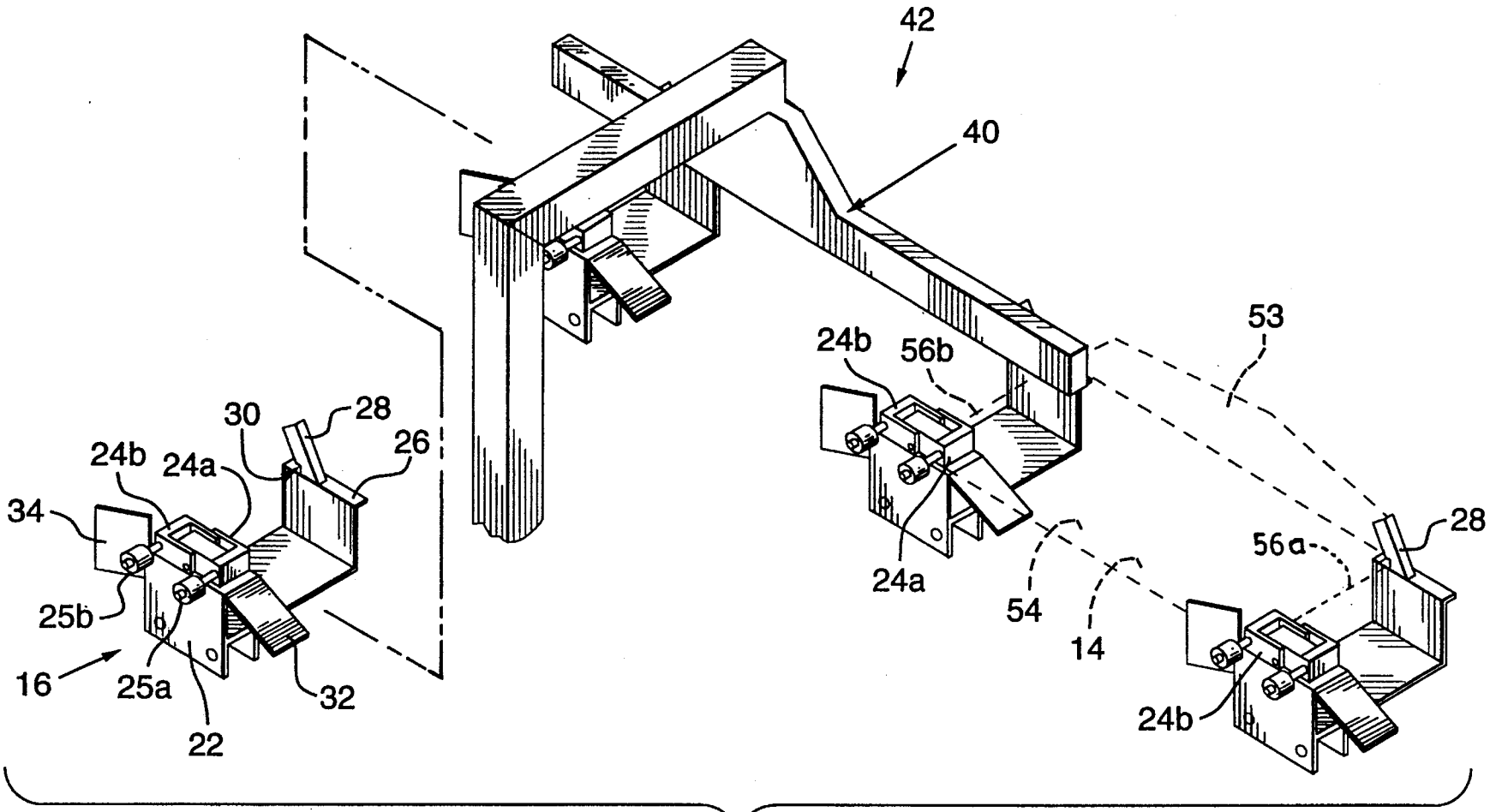
FIG. 2 is a perspective view of a portion of the envelope stuffing apparatus of FIG. 1.
Figure 3:
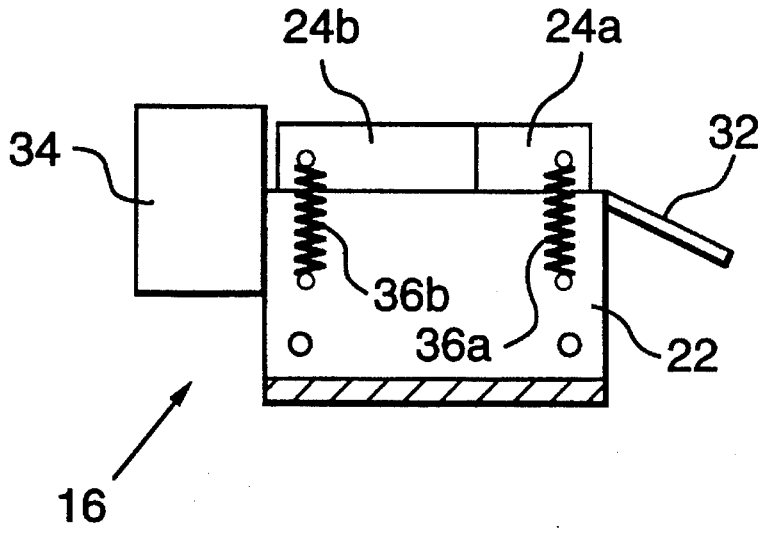
FIG. 3 is a schematic cross-sectional left side view of a portion of FIG. 2.

With reference to FIG. 1, an apparatus 10 for stuffing a stack 12 of inserts (shown in phantom in FIG. 1) into an envelope 14 on-the-fly includes a envelope conveyor 15 having support assemblies 16 mounted on an endless chain 18 for continuous movement in a downstream direction 19 along a first path 20. The envelopes are of conventional configuration having a back panel 51 (FIG. 6*b*) with a flap 53, a front panel 54 meeting the back panel at side 56*a*, 56*b* and bottom 58 edges and an opening 60 at the base of the flap. Referring to FIG. 2, the support assemblies 16 comprise a block 22 to which is mounted a jaw 24*a* for gripping the downstream side edge 56*b* of an envelope and a second jaw, jaw 24*b*, for gripping the upstream side edge 56*a* of an envelope. Cam rollers 25*a*, 25*b* depend from jaws 24*a*, 24*b*, respectively. An envelope supporting ledge 26 depends from block 22 and is laterally spaced from the block 22. Each support ledge 26 has a finger 28 with a notch 30 for receiving the upstream side edge of an envelope. An upstream guide 32 and a downstream guide 34 also depend from the block 22. Turning briefly to FIG. 3, springs 36*a*, 36*b* bias jaws 24*a*, 24*b*, respectively, to a position whereat they are clamped closed against block 22.

Returning to FIGS. 1 and 2, a vacuum bar 40 overlies the support assemblies 16 laterally between the blocks 22 and support platforms 26 at an inserting station 42.

Figure 4:
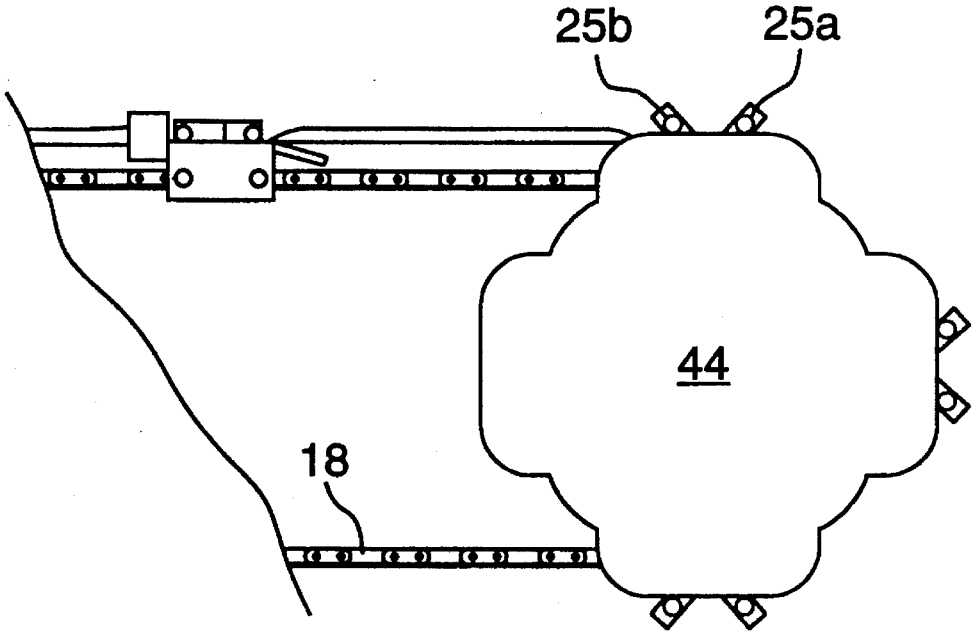
FIG. 4 is a schematic side view of a portion of the envelope stuffing apparatus of FIG. 1.

With reference to FIGS. 1 and 4, the cam rollers 25*a*, 25*b* of the jaws are cammed by cam wheel 44 which is geared to rotate so that its periphery moves in synchronism with the support assemblies of envelope conveyor 15. With sole reference to FIG. 1, the cam wheel is positioned at an envelope loading station 46. An envelope dispenser and flap opener 48 is also positioned at the loading station. The envelope dispenser and flap opener comprises a pair of parallel feed belts 50*a*, 50*b* and a medial feed belt 52 all of which descend in the downstream direction toward the envelope conveyor 15. The medial feed belt 52 descends at a slightly greater angle than the belts 50*a*, 50*b* so that the lower run of the medial belt is below the upper run of the outside belts 50*a*, 50*b*, at least nearer the downstream end of the belts (seen in FIG. 6*b*). A flap guide 53 extends from the downstream end of the feed belts in the downstream direction 19.

Figure 5:
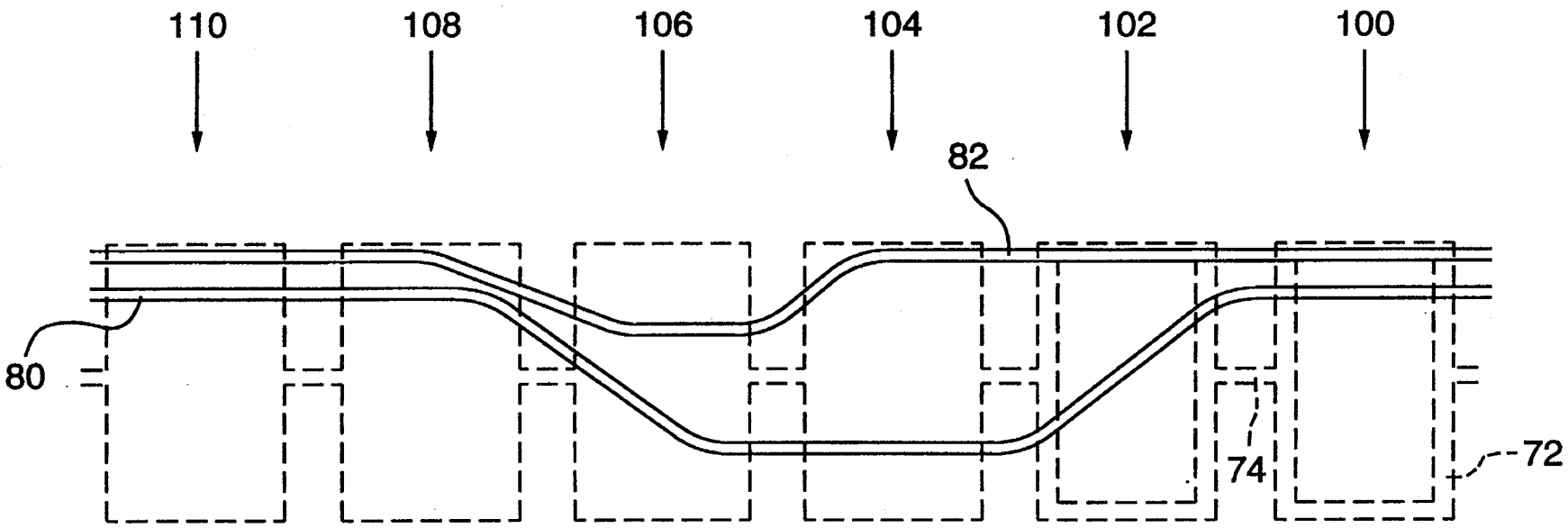
FIG. 5 is a schematic top view of a portion of the envelope stuffing apparatus of FIG. 1, FIGS. 6*a* and 6*b* are top views of a portion of FIG. 1 illustrating the operation of a portion of the envelope stuffing apparatus of FIG. 1, and FIGS. 7*a* and 7*b* are perspective views of a portion of the envelope stuffing apparatus of FIG. 1 illustrating the operation of this portion of the apparatus.

With reference to FIGS. 1 and 5, a conveyor of rail sets 72 joined by chains 74 parallels the envelope conveyor 15 and is geared to the envelope conveyor 15 so that the rails move in downstream direction 19 in synchronism with the envelope conveyor. A tray 70 is slidably mounted on each rail set 72 for movement transversely of path 20. The trays support stacks 12 of inserts. An insert pusher 76 is slidably mounted in a slot 78 of each tray for movement transversely of path 20. Each tray has a cam pin (not shown) which rides in cam track 80 (FIG. 5) and each pusher 76 has a cam pin (not shown) which rides in cam track 82 (FIG. 5).

Figure 7A:
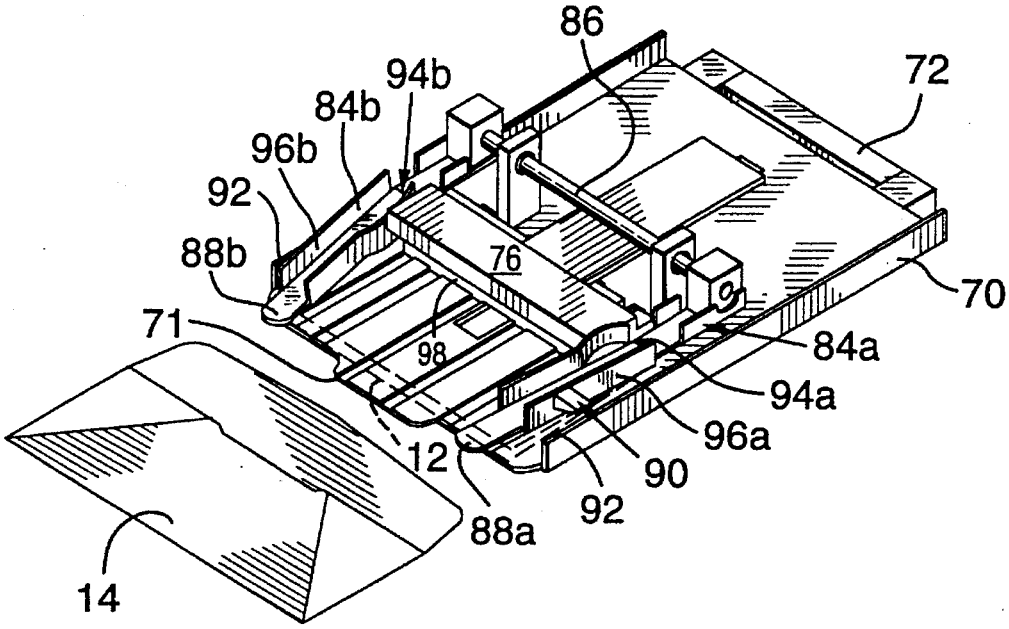

With reference to FIG. 7*a*, each tray has a pair of arms 84*a*, 84*b* pivotally mounted to the tray at one end on shaft 86 so that the arms have free ends 88*a*, 88*b*, respectively. In the position illustrated in FIG. 7*a*, the arms rest atop a stack 12 of inserts. Each arm has a ramping wedge 90 and the trays have ramping ledges 92 adjacent each ramping ledge. Each arm is articulated at an elbow 94*a*, 94*b* and the lower arms 96*a*, 96*b* are biased by springs (not shown) to cant toward one another. The tray has a forward edge 71 and it will be noted that the pusher 76 has an undercut 98. The undercut 98 in the insert pusher simply provides a ceiling for the back edge of a stack of inserts on the tray which assists in keeping the stack in place on the tray.

Figure 6A:
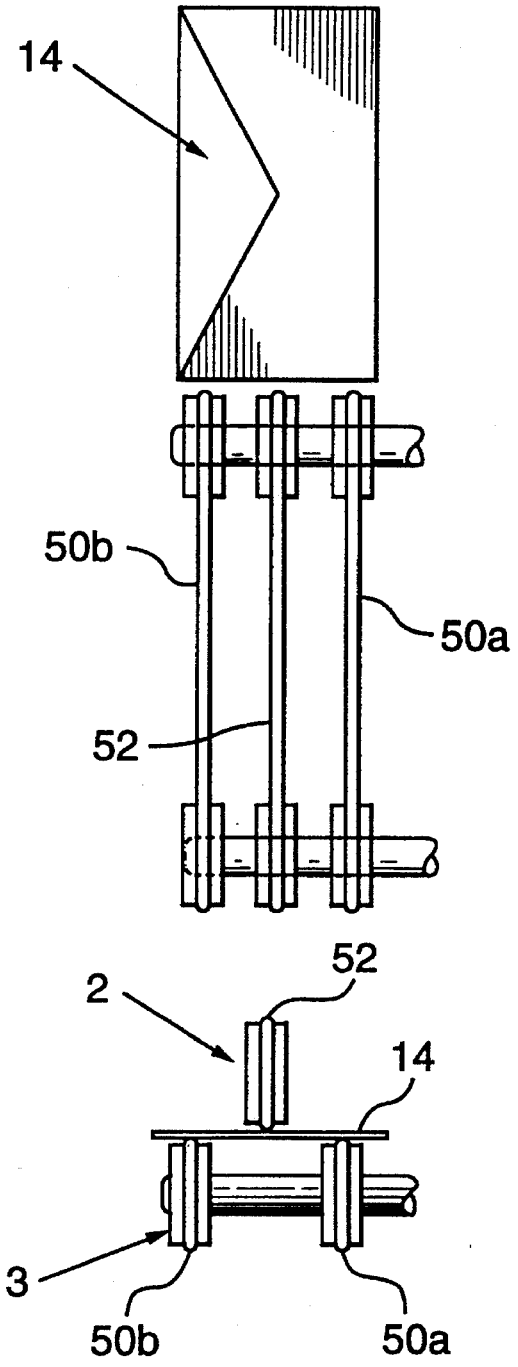
Figure 6B:
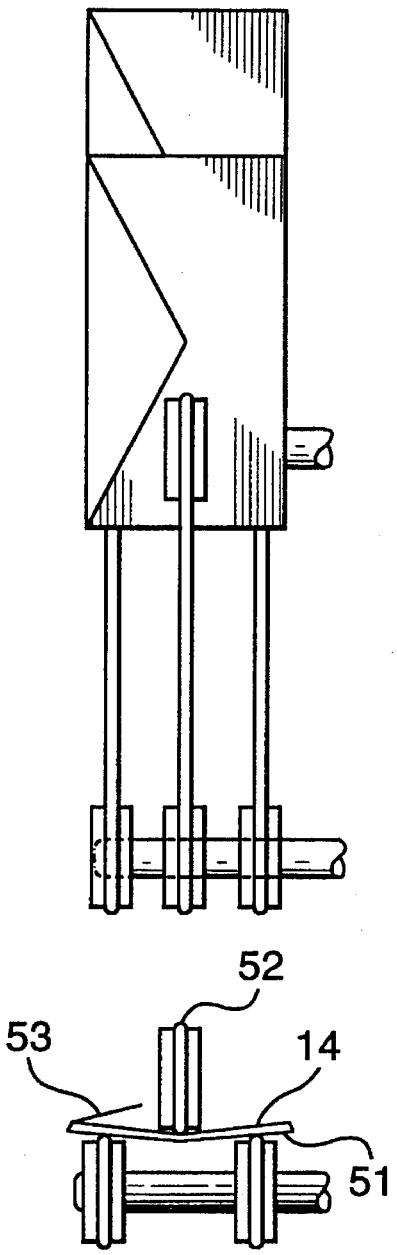

In operation of the apparatus, envelopes 14 are fed by the feed belts 50*a*, 50*b*, 52 of the envelope dispenser and flap opener 48. With reference to FIGS. 6*a* and 6*b*, it will be noted that envelopes are fed lengthwise between underlying belts 50*a*, 50*b* and overlying belt 52 with the back panel 51 of the envelope against belts 50*a*, 50*b*. However, because belt 52 descends at a slightly greater angle than belts 50*a*, 50*b*, as an envelope feeds downstream, it becomes slightly bent between the belts. This causes the envelope flap 53 to partially open, as seen in FIG. 6*b*.

Returning to FIG. 1, the flap guide 53 is positioned at the downstream end of the belts so that it is interposed between the partially opened flap of the envelope and the remainder of the envelope.

Conveyor 15 is timed to move in the downstream direction 19 in synchronism with the feed belts. Referencing FIGS. 1 through 4, the feed belts dispense an envelope with the downstream edge 56*b* of the envelope resting on a block 22 and a laterally adjacent envelope ledge 26 of a support assembly under jaw 24*a* of the block just prior to the cam wheel 44 releasing the cam roller 25*a* of the jaw 24*a*. Consequently, when the jaw 24*a* is released, it grips the downstream side edge 56*b* of the envelope toward the bottom edge 58 of the envelope. An envelope gripped by a jaw 24*a* moves with the support platform downstream along path 20. The cam wheel 44 is sized such that it rotates one-quarter revolution to release jaw 24*b* of the next upstream support assembly 16 at the point when the upstream side edge 56*a* of the envelope rests on the block 22 of that support assembly below its open jaw 24*b*. Thus this jaw 24*b* grips the upstream side of the envelope toward the bottom edge 58 of the envelope. The result is shown in FIG. 2 with an envelope 14 shown in phantom. The ledges 26 of adjacent support assemblies support the back panel of the envelope proximate the flap 53 thereof while leaving the front panel of the envelope free to move away from the back panel. It will be noted that the envelope is unsupported other than at the jaws 24*a*, 24*b* and the ledges 26.

Guide panel 32 of the support assemblies act as a guide surface for the downstream side edge of the envelope as the envelope is dispensed into an open jaw 24*a*. Guide panel 34 assists in ensuring proper registration of the upstream side edge 56*a* of an envelope as the upstream edge drops onto the block 22 of the upstream support assembly 16. The notch in finger 28 depending from ledge 26 also assists in proper registration of the envelope.

As an envelope moves downstream from the feed belts 50*a*, 50*b* and 52, flap guide 53, which has a one-hundred and eighty degree bend along its longitudinal axis, acts to fully open the flap of the envelope.

Figure 7B:
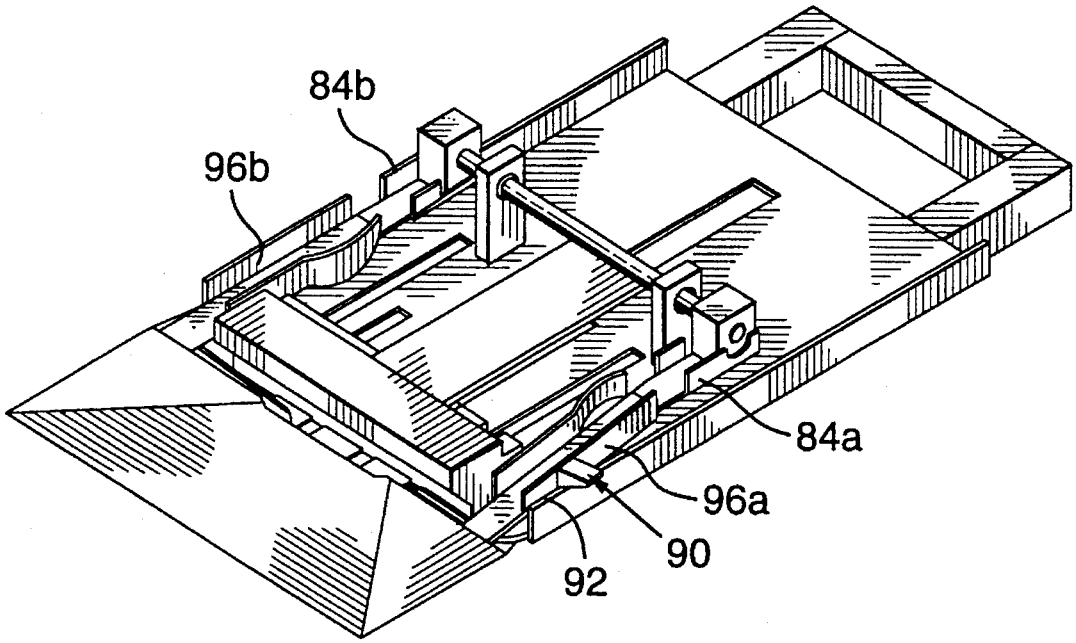

Referencing FIGS. 1 and 5, as a rail 72 supported tray 70 with a stack 12 of inserts moves from the position illustrated at 100 downstream to position 102, the tray cam pin (not shown) is cammed by cam track 80 to begin to advance the tray toward path 20. In so doing, the forward edge 71 of the tray moves over the flap of an envelope which is moving downstream in synchronism with the rails 72. As the tray moves toward the position indicated at 104, the envelope paralleling the tray moves under vacuum bar 32 which acts to draw the front panel 54 of the envelope away from the envelope's back panel proximate the flap 53. Simultaneously, the tray is cammed to its forwardmost position indicated at position 104 whereat the leading edge of the tray, and the free ends 88*a*, 88*b* of the arms, move through the opening 60 of the envelope and between the front and back panels of the envelope. Once this occurs the vacuum bar 32 is no longer necessary and it will be noted that an envelope passes the vacuum bar as it moves from position 104 to position 106. As a tray passes position 104, the insert pusher cam pin (not shown) is cammed by cam track 82 so that the pusher 76 moves toward path 20 pushing the stack of inserts on the tray toward the envelope. As illustrated in FIG. 7*b*, when the pusher moves forward, it acts against the lower arms 96*a*, 96*b* of arms 84*a*, 84*b* causing the lower arms (which were canted toward each other) to move away from each other. This in turn ramps wedges 90 of these lower arms up tray ledges 92 so that the leading ends of the arms are raised. This moves the front panel of the envelope further away from the envelope's back panel further opening the envelope. As the pusher moves to its forwardmost position illustrated in FIG. 7*b*, the stack of inserts is pushed fully into the envelope. The position of tray and pusher illustrated in FIG. 7*b* is intermediate of the positions illustrated at 104 and 106 in FIG. 1. It will be apparent that since the stack of inserts is sandwiched between the tray and arms, the tray, which overlies the back panel of the envelope, and the arms, which underlie the front panel of the envelope, define a feed path for the stack of inserts into the envelope.

At position 106 the tray begins to be withdrawn. As the tray moves to position indicated at 108, the tray is fully withdrawn and the pusher is in the process of being retracted. By the position indicated at 110, the pusher is fully retracted.

It will be apparent from the foregoing description that camming groove 80 (which moves each tray 70 toward an envelope) and camming groove 82 (which moves the insert pusher of each tray toward an envelope) co-operate to move each stack of inserts along a second path which merges with the first path along which the envelopes are conveyed. Gripping the envelope proximate its bottom edge ensures the jaws do not rip the envelope when it is opened by the vacuum bar and arms.

The envelope with inserts then moves downstream for further processing. The trays are on an endless conveyor and on the return, the pairs of arms 86*a*, 86*b* may be cammed away from their associated trays permitting the dispensing of a further insert stack onto the trays. Thereafter, each pair of arms may be cammed to rest against the top of the further stack of inserts so that the arms are again in a stack guiding position and the loaded tray is once more ready for dispensing a stack of inserts.

Modifications will be apparent to those skilled in the art and, accordingly, the invention is defined in the claims.

What is claimed is:

1. An on-the-fly envelope stuffing apparatus for an envelope of the type having a back panel with a flap, a front panel meeting said back panel at side and bottom edges and an opening at the base of said flap, comprising the following:

means to convey an envelope downstream continuously along a first path;

means to support the back panel of the envelope while leaving the front panel proximate the flap proximate said opening free to move away from the back panel;

means to continuously convey a stack of one or more inserts downstream along a second path, said first path and said second path merging at an inserting station, said insert conveying means comprising an insert support for supporting a stack of inserts, and a pusher for pushing said stack of inserts from said insert support at said inserting station;

means to form a feed path for said stack of inserts from said insert support to an envelope at said inserting station comprising a pair of arms mounted to said insert support, each arm of said pair of arms having a free end, said pair of arms moveable to a guiding position whereat each free end is adjacent a top of a stack of inserts on said insert support and whereat, at said inserting station, said pair of arms project toward said first path sufficiently that each said free end merges into said opening of said envelope, said pair of arms moveable while in said guiding position such that the free ends of said arms move away from each other, and means to move said pair of arms when in said guiding position at said inserting station such that the free ends of said pair of arms move away from each other to adjacent the side edges of the envelope.

2. The envelope stuffing apparatus of claim 1 wherein said arms are biased to a position whereat they are canted toward each other and wherein said means to move the free ends of said pair of arms away from each other comprise said pusher which pushes between said arms at said inserting station.

3. The envelope stuffing apparatus of claim 2 wherein said means to form a feed path comprises means to raise the free ends of said arms at said inserting station when said free ends are within said opening.

4. The envelope stuffing apparatus of claim 3 wherein said means to raise said free ends comprise a wedge mounted proximate each free edge which rides upwardly on a ramping surface of said insert support when said free ends are moved away from each other.

5. The envelope stuffing apparatus of claim 1 including means upstream of said envelope conveying means for opening the flap of an envelope comprising a pair of parallel feed belts for supporting the back panel of said envelope and a medial feed belt laterally aligned with said pair of parallel feed belts and which is below the level of said pair of feed belts at least at a downstream end of said feed belts, said feed belts for feeding an envelope in said downstream direction while said medial feed belt acts against the front panel of said envelope to bend said envelope in order to partially open said flap.

6. The envelope stuffing apparatus of claim 5 wherein said means for opening the flap of said envelope includes a flap guide stretching from the downstream end of said feed belts for extending between said flap and said front panel of said envelope when partially opened in order to fully open said flap.

7. The envelope stuffing apparatus of claim 1 including means to move the front panel of the envelope proximate the envelope opening away from the back panel of the envelope at said inserting station.

8. The envelope stuffing apparatus of claim 4 wherein said arms are mounted to said insert support for pivoting in order to move said free ends of said arms toward and away from said insert support and such that said arms, when in said guiding position, rest atop a stack of inserts on the insert support.

9. The envelope stuffing apparatus of claim 8 wherein said supporting means comprises two ledges, one underlying the back panel of the envelope at each side edge of the envelope proximate said flap and wherein said conveying means comprises a pair of grippers, one to grip each side edge of said envelope proximate the bottom edge of said envelope.

10. The envelope stuffing apparatus of claim 9 wherein said grippers are spring biased to a gripping position and have camming pins affixed thereto and wherein said conveying means further comprise an endless conveyor supporting said grippers and wherein said envelope stuffing apparatus comprises a cam wheel for acting against the cam pin of a given gripper in order to cam the given gripper to an open position upstream of an envelope loading station and to allow the given gripper to return to a closed position at said envelope loading station.

11. The envelope stuffing means of claim 7 wherein said means to move said front surface of an envelope is a vacuum bar.

12. An on-the-fly envelope stuffing apparatus for an envelope of the type having a back panel with a flap, a front panel meeting said back panel at side and bottom edges and an opening at the base of said flap, comprising the following:

means for opening the flap of an envelope comprising a pair of parallel feed belts for supporting the back panel of said envelope and a medial feed belt laterally aligned with said pair of parallel feed belts and which is below the level of said pair of feed belts at least at a downstream end of said feed belts, said feed belts for feeding an envelope in said downstream direction while said medial feed belt acts against the front panel of said envelope to progressively bend said envelope in order to partially open said flap;

means to convey said envelope continuously downstream from said envelope opening means along a first path;

means to continuously convey a stack of one or more inserts downstream along a second path, said first path and said second path merging at an inserting station.

13. A method for on-the-fly envelope stuffing comprising the following steps:

continuously conveying an envelope of the type having a flap downstream along a first path;

bending said conveyed envelope along its length in order to partially open the envelope flap;

fully opening the envelope flap;

conveying a stack of one or more inserts downstream along a second path;

merging said first path and said second path at an inserting station whereby inserts are fed into said envelope.

14. The method of claim 13 including the step of supporting a back panel of the envelope proximate side edges of the envelope while leaving a front panel of the envelope proximate the flap free to move away from the back panel.

15. The method of claim 14 wherein the step of merging said first path and said second path comprises pushing said stack of inserts from an insert support supporting said stack.

16. The method of claim 15 including the step of forming a feed path for said stack of inserts from said insert support to said envelope by positioning free ends of a pair of arms in resting relationship adjacent the top of said stack of inserts, moving the arms into an opening of said envelope, and separating the free ends of the arms so that each free end is positioned adjacent one of said side edges of said envelope.

17. A method for on-the-fly envelope stuffing comprising the following steps:

conveying an envelope having a open flap downstream along a first path;

supporting a back panel of the envelope proximate side edges of the envelope while leaving a front panel of the envelope proximate the flap free to move away from the back panel;

conveying a stack of one or more inserts downstream along a second path;

merging said first path and said second path at an inserting station including the step pushing said stack of inserts from an insert support supporting said stack;

forming a feed path for said stack of inserts from said insert support to said envelope at said inserting station comprising positioning the free ends of a pair of arms in resting relationship adjacent a top of said stack of inserts, moving the arms into an opening of said envelope, and separating the free ends of the arms so that each free end is positioned adjacent one of said side edges of said envelope whereby inserts are fed into said envelope.

* * * * *

UNITED STATES PATENT AND TRADEMARK OFFICE

CERTIFICATE OF CORRECTION

PATENT NO. : 5,457,941

DATED : October 17, 1995

INVENTOR(S) : John D. Long, John A. Long

It is certified that error appears in the above-indentified patent and that said Letters Patent is hereby corrected as shown below:

Column 8, line 25, after step insert --of--.

Signed and Sealed this

Sixteenth Day of January, 1996

Bruce Lehman

*Attest:*

BRUCE LEHMAN

*Attesting Officer*

*Commissioner of Patents and Trademarks*